US007559126B2

(12) United States Patent
Giampavolo

(10) Patent No.: US 7,559,126 B2
(45) Date of Patent: Jul. 14, 2009

(54) SAFETY BUCKLE WITH MULTIPLE ORIENTATION CLASP

(76) Inventor: Paul Giampavolo, 10 Kingsbridge Rd., Fairfield, NJ (US) 07004

( * ) Notice: Subject to any disclaimer, the term of this patent is extended or adjusted under 35 U.S.C. 154(b) by 0 days.

(21) Appl. No.: 10/811,168

(22) Filed: Mar. 26, 2004

(65) Prior Publication Data

US 2005/0210640 A1 Sep. 29, 2005

(51) Int. Cl.
*A44B 11/25* (2006.01)
*A44B 11/26* (2006.01)

(52) U.S. Cl. ..... 24/625; 24/615; 24/662

(58) Field of Classification Search ..... 24/614, 24/615, 625, 664
See application file for complete search history.

(56) References Cited

U.S. PATENT DOCUMENTS

| | | | | | |
|---|---|---|---|---|---|
| 4,458,392 | A | * | 7/1984 | Pogharian et al. | 24/664 |
| 4,712,280 | A | * | 12/1987 | Fildan | 24/625 |
| 5,263,726 | A | | 11/1993 | Wood | 280/33.992 |
| D359,464 | S | | 6/1995 | Grasso et al. | D11/216 |
| 5,465,472 | A | | 11/1995 | Matoba | 24/625 |
| 5,659,931 | A | | 8/1997 | Anscher | 24/614 |
| 5,774,956 | A | | 7/1998 | French et al. | 24/625 |
| 5,855,057 | A | * | 1/1999 | Anscher | 24/614 |
| 5,991,985 | A | | 11/1999 | Galbreath | 24/625 |
| 6,000,109 | A | * | 12/1999 | Anscher | 24/614 |
| 6,138,330 | A | | 10/2000 | Galbreath | 24/625 |
| 6,311,374 | B1 | | 11/2001 | Anscher | 24/625 |
| 6,446,314 | B1 | * | 9/2002 | Anscher | 24/614 |
| 6,662,414 | B1 | * | 12/2003 | Niewiadomski | 24/625 |
| 6,684,466 | B2 | | 2/2004 | Nishida et al. | 24/615 |
| 6,728,999 | B2 | * | 5/2004 | Murai et al. | 24/615 |

FOREIGN PATENT DOCUMENTS

| | | | |
|---|---|---|---|
| EP | 0 348 075 A1 | * | 12/1989 |
| GB | 2 150 632 A | * | 7/1985 |
| JP | 07051106 A | * | 2/1995 |
| JP | 408-84610 | * | 4/1996 |
| JP | 2001-61514 | * | 3/2001 |
| WO | WO 84/01275 | | 4/1984 |

* cited by examiner

*Primary Examiner*—Robert J Sandy
*Assistant Examiner*—Ruth C Rodriguez
(74) *Attorney, Agent, or Firm*—Weingarten, Schurgin, Gagnebin & Lebovici LLP

(57) ABSTRACT

A double action reversible safety buckle is disengaged by pinching side arms together to be free of the socket, while depressing a button or other device to free an internal latch from a catch on the socket. The plug or the socket is symmetrical with respect to the latch on the catch, so that the buckle may be clasped and secured without regard for the orientation of the socket and the plug. The internal latch may be made to be operated concurrently with the side arms, or sequentially to provide additional safety.

12 Claims, 7 Drawing Sheets

SAFETY BUCKLE WITH MULTIPLE ORIENTATION CLASP

BACKGROUND OF THE INVENTION

1. Field of the Invention

The present invention relates generally to safety buckles used with a strap, and relates more particularly to child resistant safety buckles for securing a child in a seat.

2. Description of the Related Art

Child resistant safety buckles are used in a number of applications including securing children in car seats, high chairs and shopping carts. A particular type of safety buckle is child resistant, to prevent children under a given age from releasing the buckle and freeing themselves, leading to a potentially dangerous or injurious situation. Although children under a certain age are prevented from unclasping the buckle, adults typically have no difficulty in disengaging the buckle to free the child. One type of buckle that is child resistant but can be opened by an adult has a double action feature to permit the buckle to be opened. That is, the buckle is opened by operating several disengaging elements to unlatch the buckle and disengage the buckle portions. By providing two actions to allow the buckle to be opened, the buckle is made child resistant, because a typical child under a certain age is unable to properly operate the two features, either sequentially or at the same time, for example, to unlatch and open the buckle. At the same time, an adult can easily and intuitively disengage the buckle by operating the two features as required.

A number of buckles are available that, while not designed to be child resistant, are provided to withstand heavy loading, so that the buckles will not disengage unexpectedly. These types of buckles also have a multi-open feature, in that a number of operations must be conducted on the buckle to permit the buckle to be unlatched and opened. Typical applications for these type of buckles involve heavy duty or industrial uses, such as clasps for utility belts, sportswear or other applications, where the buckle is subjected to high loading or must be well secured.

One such high security buckle is shown in U.S. Pat. No. 5,774,956 to French et al., which discloses a buckle with flexible side release latches and a third latch accessible on the front of the buckle. The male portion of the buckle includes a central latch arm that engages the female portion of the buckle in a central portion, and is released by pressing on a central button on one side of the female buckle portion. The buckle unlatches when both side latch arms are moved inwardly, and the central arm is moved away from the catch on the female portion. The buckle unlatches when all three arms are moved to unlatched positions simultaneously. Changing the orientation of the male portion when inserted into the female portion results in the central arm catch being defeated, because there is no corresponding catch cooperation on the back side of the female.

U.S. Pat. No. 5,991,985 to Galbreath discloses a safety buckle with side catch arms and a central catch that engages with a depressible button catch on the female portion of the buckle. To disengage the buckle, the central button on the female portion of the buckle is depressed to either disengage from the central arm or displace the central arm to disengage from a catch. If the male portion of buckle is inserted into the female portion of the buckle in an opposite orientation so that the central arm does not engage the depressible button catch, the buckle either does not clasp or the central arm does not latch.

U.S. Pat. No. 6,311,374 to Anscher shows a two-operation buckle with a center arm that includes a push button near the base of the male member with a catch near the push button to engage an opening catch in the female member when the buckle portions are engaged. In this configuration, it is somewhat difficult to depress the push button on the center arm of the male member to disengage the latch button from the opening in the female member. That is, the push button on the center arm near the base of the male member requires more leverage to displace the center arm to free the center latch from the opening in the female member. The additional leverage required, coupled with the need to depress the side arms together to unlatch the buckle, makes the configuration difficult for adults and children alike to disengage the buckle. In addition, the buckle is non-reversible, i.e., if the male member is inserted in an opposite orientation, so that the push button faces the back of the buckle assembly, the male and female members do not engage with each other.

U.S. Pat. No. 6,684,466 to Nishida et al. teaches a two-operation safety buckle in which the male member has a center arm with a catch recess that engages a catch on the female member. The center arm of the male member is displaced downwardly during insertion to permit the latch member to protrude into the latch recess when the male member is fully inserted and the center arm returns to its undisplaced position. The center arm is disengaged from the catch with a button on the female member that is pressed to displace the center arm away from the catch of the female member, so that the male member can be withdrawn from the female member, with the sidearms being depressed together. This buckle configuration is not reversible, in that if the male is inserted in an opposite orientation, the center arm does not latch with the female latch member. For example, if the buckle deforms, a situation where the buckle is able to be clasped but not unclasped may occur.

U.S. Pat. No. 6,138,330 to Galbreath discloses a two-operation safety buckle in which the sidearms of the male member are prevented from being depressed together to unlatch the buckle, when the male and female members are engaged together. A blocking device in the female member engages with the latching arms of the male member to prevent their displacement and thus prevent them from being unlatched until the blocking member is displaced away from the latching arms to permit their relative movement. Accordingly, the blocking member is first displaced, and then the arm latches are displaced towards each other until they are free of their respective latches in the female member, at which point the male member can be withdrawn from the female member. The configuration of this buckle permits the male member to be inserted in an opposite orientation, however the buckle is difficult to manufacture due to practical tolerance limitations in the materials. In addition, the buckle configuration is not designed to withstand high impact or compressive forces that are typically encountered in safety buckle applications.

In each of the above two-operation safety buckles, a change in the orientation of the male member when being inserted into the female member causes the buckle either not to clasp, or defeats the operation of the second operation needed to unclasp the buckle. In a case of the '330 patent to Galbreath, reversing the orientation of the male member does not defeat the two-operation feature of the buckle, however, the buckle operates by preventing the latching arms of the male member from being displaced to be unlatched, which impairs the manufacturability of the buckle and creates difficulties for the user in unlatching the buckle. In addition, there are challenges to making the buckle of the '330 patent to Galbreath impact resistant or durable in stressful environments. For example, if the buckle becomes deformed due to impact or compression, it is extremely difficult to unlatch the buckle.

Accordingly, it would be desirable to obtain a two-operation safety buckle that is independent of the orientation of the male member in the female member that provides robust operation in practice with ease of manufacturability.

SUMMARY OF THE INVENTION

In accordance with the present invention, there is provided a two-operation safety buckle in which the male member may be inserted in a random orientation while preserving the functionality of the two-operations to unlatch the buckle. The invention is accomplished by modifying either the male or female member to provide an orientation balanced latching mechanism.

In accordance with a first embodiment of the present invention, a male member is provided with a center arm having a projection for latching with a female portion of a buckle. The latching projection of the male member is provided on either side of a center arm of the male member, so that the male member latches with a single mating latch on the female member independent of the orientation of the male member. The male member is disengaged from the female member by displacing the center arm away from the female latch member, while displacing a pair of sidearm latches towards each other so that the male portion of the buckle is free to be disengaged from the female portion of the buckle.

In accordance with another embodiment of the present invention, two female latch members are provided on either side of an inner chamber of the female portion of the buckle. A mating latch projection is provided on the center arm of the male portion of the buckle, so that the engagement and latching of the male and female portions is independent of the orientation of the male member.

In accordance with either of the previous embodiments, variations thereof may include one or more buttons on the female member for disengaging the latch members, a button on the male member. The various buttons may control the latching members by displacing a latching member that is connected directly to the one or more buttons, or by displacing the center member by contact and thereby disengaging the latching members.

In accordance with another embodiment of the present invention, a single aperture is provided on the center arm of the male member for receiving a single latch projection extending from a side of the female inner chamber. Engagement and disengagement is controlled by a thumb tab on the female member be which the latch projection can be inserted and removed from the aperture.

In yet another embodiment of the present invention, the male member is not provided with a center member. The pair of sidearm latches are provided with a grooved surface for engaging a latching projection on the inner surface of the female member. The sidearm latches are disengaged from the latching projection by a button on the female member, which, when activated, displaces the sidearms away from the latching projection.

The buckle of the present invention is composed of a flexible and durable material designed to withstand impact or compressive forces to avoid permanent deformation of the buckle. The buckle may be molded from a variety of extrudable materials. These materials may include LDPE, HDPE, ABS, polystyrene, polypropylene, acetates, butyrates, nylons, impact modified nylons, rubberized nylons, polyphenylene sulfides, acetals, polycarbonates, thermoplastic rubbers, and polyesters, among others. According to another feature of the present invention, the buckle is formed to have latching arms in the male portion that exhibit a particular force resistance to being compressed together. According to this feature, a child is typically unable to compress the latching arms of the male member sufficiently to disengage the buckle, even if the second operation structure is unlatched.

Other features and advantages of the present invention will be apparent from the following detail description to be read with the accompanying drawings as described below.

DETAILED DESCRIPTION OF THE PREFERRED EMBODIMENTS

Figure 1A:
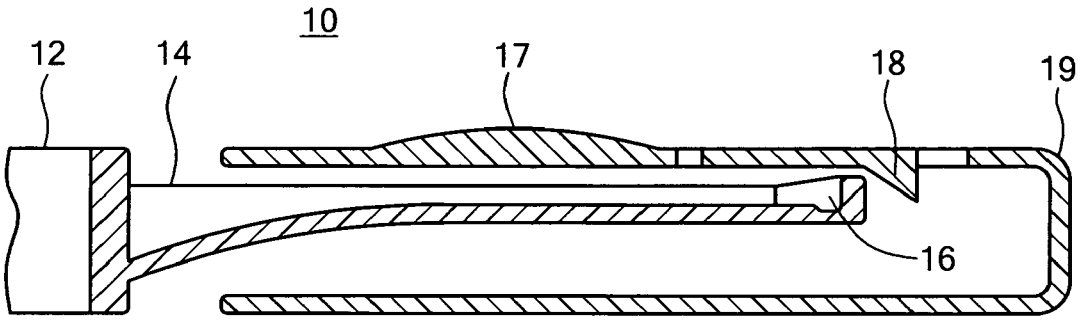
FIG. 1a PRIOR ART
FIGS. 1*a* through 1*c* illustrate a central cross-sectional view of a conventional two-operation safety buckle.
Figure 1B:
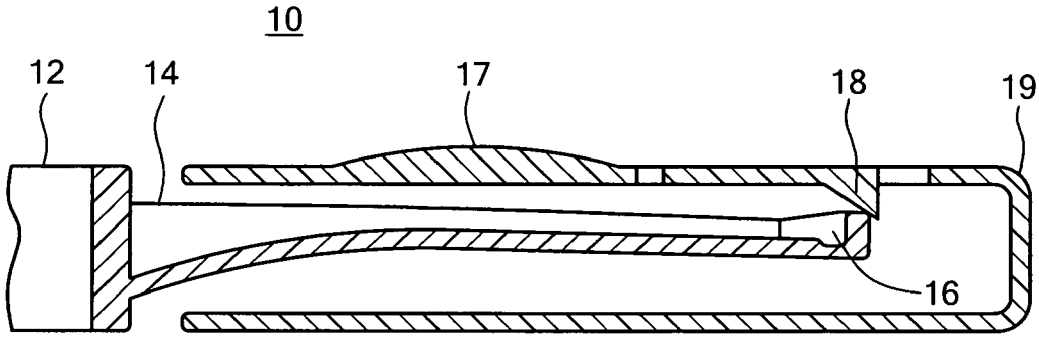
FIG. 1b PRIOR ART
Figure 1C:
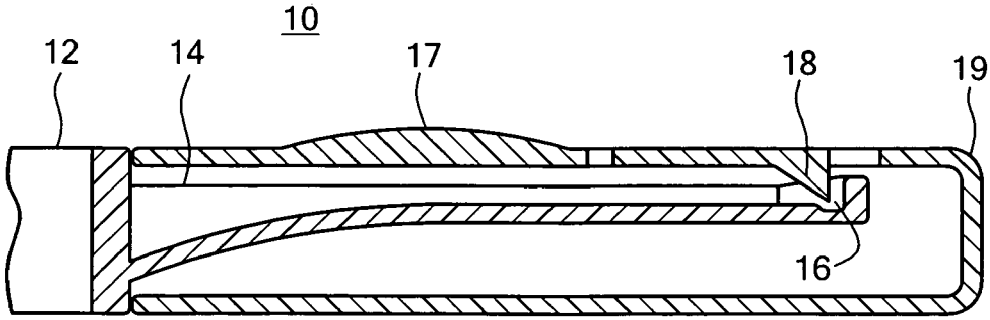
FIG. 1c PRIOR ART

FIGS. 1*a* through 1*c* illustrate a central cross-sectional side view of a conventional two-operation safety buckle 10. Buckle 10 comprises a male member 12 having a center arm 14 with a catch recess 16 that engages a catch 18 on the female member 19. As illustrated in FIG. 1*b*, the center arm 14 of the male member 12 is displaced downwardly during insertion to permit the latch 18 to protrude into the latch recess 16 when the male member 12 is fully inserted and the center arm 14 returns to its undisplaced position, as seen in FIG. 1*c*. A button 17 is located on female member 19 for disengaging central arm 14 from the catch 18. Pressing button 17 displaces center arm 14 away from catch 18 of female member 19, so that male member 12 can be withdrawn from female member 19. Buckle 10 is not configured to be reversible, meaning that if male member 12 is inserted in an opposite orientation, with center arm 14 facing a bottom of female member 19, center arm 14 does not engage latch 18.

Figure 2:
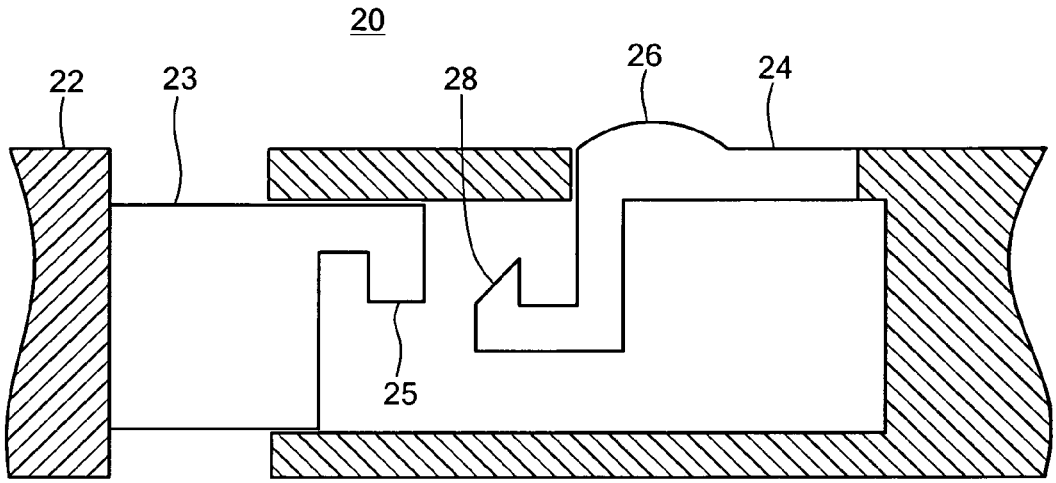
FIG. 2 PRIOR ART
FIG. 2 illustrates a central cross-sectional side view of a second conventional two-operation safety buckle.

Referring now to FIG. 2, a central cross-sectional side view of a second conventional safety buckle 20 comprising a male member 22 and a female member 24 is illustrated. Male member 22 includes a central arm 23 having a latch 25. Female member 24 includes a depressible button 26 controlling a catch 28. When male member 22 is inserted into female member 24, latch 25 is engaged by catch 28, providing a child safety locking feature.

Male and female members 22, 24 are engaged with conventional side latches (not shown) and latch 25 cooperating with catch 28. Latch 25 rides over a sloped surface of catch 28 to displace catch 28 and button 26 downward until latch 25 slides past catch 28. Once latch 25 slides past catch 28, catch 28 is free to resiliently return to a normal position along with button 26, thereby latching buckle 20.

To disengage buckle 20, button 26 on female member 24 is depressed to disengage catch 28 from latch 25 on central arm 23 while the side latches are disengaged.

Figure 2A:
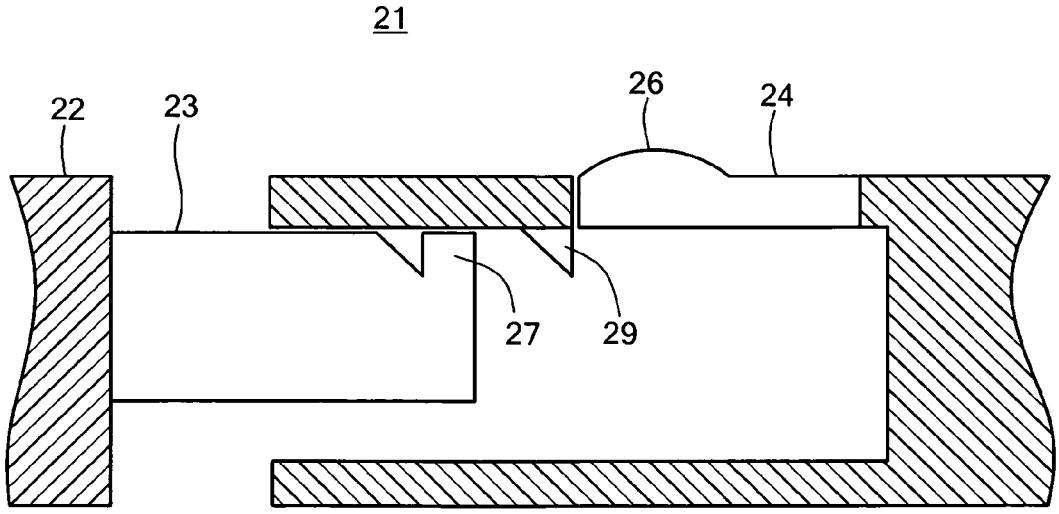
FIG. 2a PRIOR ART
FIG. 2A illustrates a central cross-sectional view of another embodiment of the buckle of FIG. 2.

Another conventional embodiment of a two action buckle 21 is shown in FIG. 2A. Buckle 21 operates by providing a latch 27 on male member 22 that engages a catch 29 on female member 24. When buckle 21 is disengaged, pressing button 26 displaces central arm 23 so that latch 27 is free of catch 29, and make and female members 22, 24 can be separated by also pressing sides arms (not shown) on male member 22 to disengage the side arms from cooperating recesses (not shown) on female member 24.

Similar to the previously described conventional safety buckle 10 as illustrated in FIG. 1, if central arm 23 of male member 22 is inserted into female member 24 of buckles 20 or 21 in an opposite orientation, then latches 25, 27 of central arm 23 do not engage catches 28, 29, thereby bypassing the two-operation child safety feature. This orientation dependence of the buckle clasp leads to the result that buckles 20, 21 do not clasp at all, or buckles 20, 21 clasp without engaging the secondary child safety lock. It is possible in these instances that the lack of engagement of the child safety lock is unobservable, so that the buckle appears secure when the two-action open feature is actually defeated.

Figure 3:
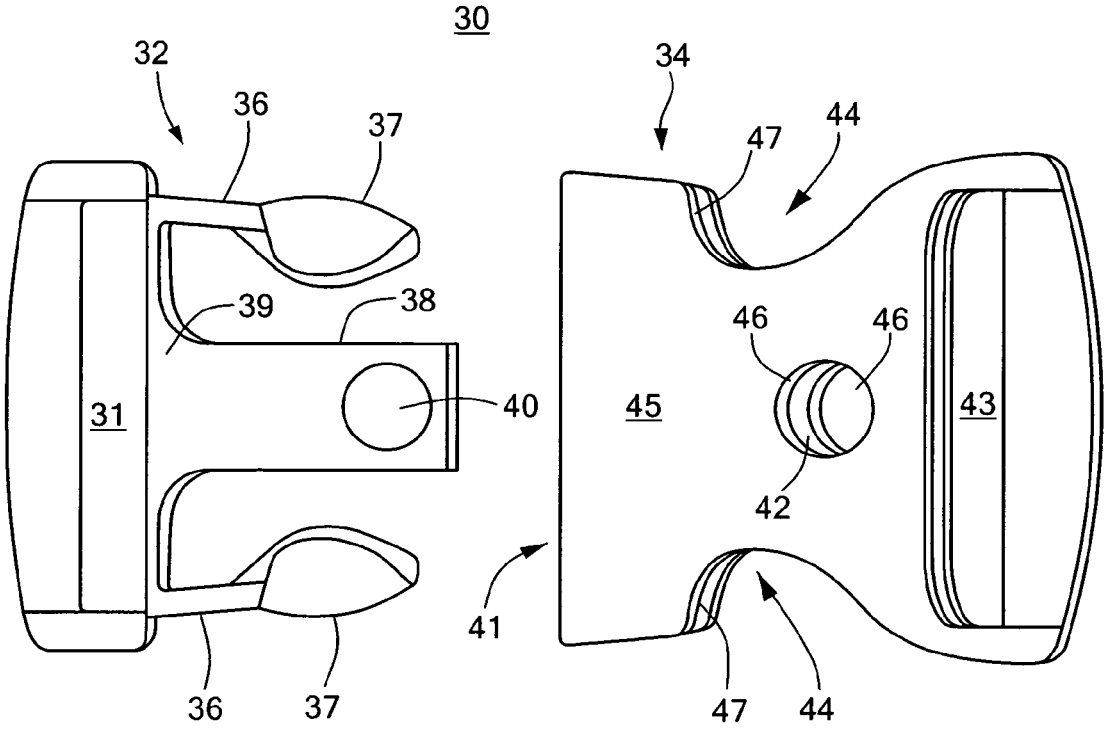
FIG. 3 illustrates a plan view of a first embodiment of a male and female portion of a two-operation safety buckle according to the present invention.

Referring now to FIG. 3, a first embodiment of a two-operation safety buckle 30 according to the present invention is illustrated. Safety buckle 30 is composed of a male member 32 and a female member 34. Male member 32 includes sidearms 36 and a center arm 38 connected to a base 39. A distal end of sidearms 36 has enlarged heads 37. Center arm 38 had a latch projection 40 extending from a distal end thereof. Extending through base 39 opposite from heads 37 is strap recess 31 for receiving a belt or other fastening instrument. Female member 34 includes an inner cavity 42 with an open end 41. Female member 34 also includes strap recess 43 for insertion of a strap or other band equivalent. Recesses 44 are provided on sides of female member 34 for receiving heads 37 of male member 32. Recesses 44 are positioned and sized to receive heads 37 at full insertion of male member 32 and are sized to allow arms 36 to resiliently return to an initial position, or a less loaded position, after being received by recesses 44.

In accordance with the present invention, a top and bottom surface of female member 34 are provided with openings 46 for receiving latch projection 40, independent of the orientation of male member 32. That is, male member 32 is securely received in female member 34 to engage heads 37 and projection 40 without regard to whether projection 40 extends toward or away from a surface 45 of female member 34. Upon insertion into female member 34, center arm 38 is biased toward a side to which latch projection 40 extends. Biased center arm 38 and latch projection 40 are sized to fit in cavity 42 of female member 34. When male member 32 is fully inserted, biased center arm 38 drives the projection 40 into opening 46 to create a second latch feature for added child safety.

When male member 32 is inserted and secure in female member 34, in either orientation, buckle 30 is unclasped with two actions, pressing projection 40 to be free of opening 46, and pinching heads 37 to be free of shoulders 47. These actions may be coordinated or sequential to unfasten buckle 30. Optionally, projection 40 may be brightly colored to assist in releasing buckle 30.

Figure 4:
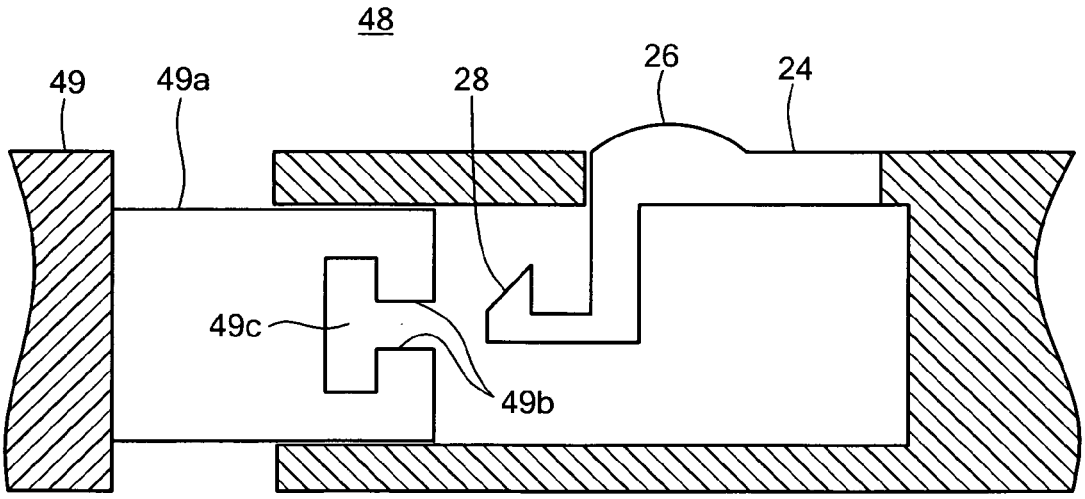
FIG. 4 illustrates side cross-sectional view of a second embodiment of a two-operation safety buckle according to the present invention.

Referring now to FIG. 4, a cross-sectional side view of another embodiment of the reversible two-action safety buckle is illustrated as buckle 48.

Buckle 48 includes conventional female buckle 24, as illustrated in FIG. 2, and male buckle portion 49 in accordance with the present invention. Male buckle 49 includes central arm 49*a* with symmetrical latches 49*b*. Latches 49*b* engage catch 28 when male buckle portion 49 is in either orientation, that is, male buckle portion 49 may be reversed and symmetrical latches 49*b* continue to function so that at least one latch 49*b* engages catch 28. Latches 49*b* are separated by a distance sufficient to permit catch 28 to be inserted and removed from a cavity 49*c* to permit latching and unlatching actions. Buckle 48 is released from a clasped configuration by depressing button 26 to disengage catch 28 from an engaged latch 49*b*.

Figure 5:
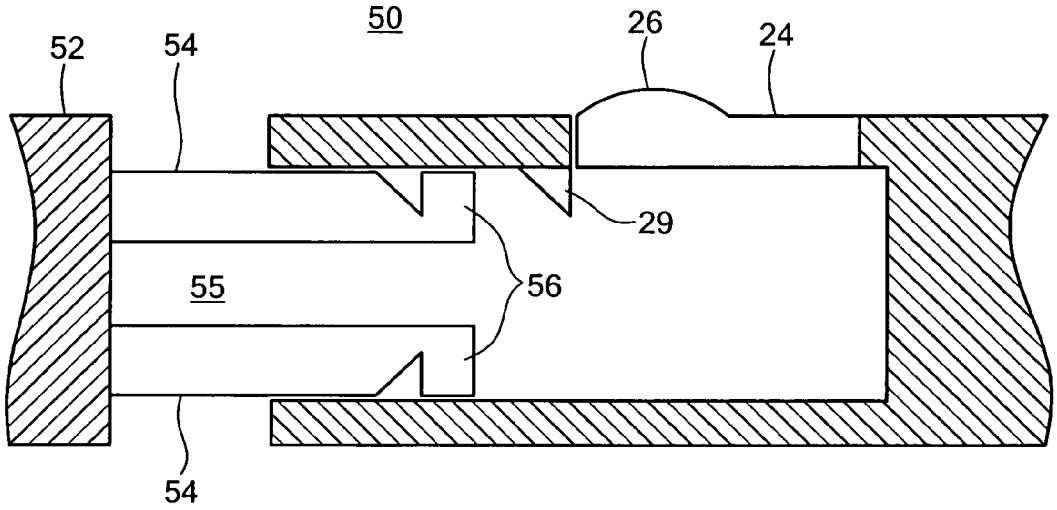
FIG. 5 illustrates a cross sectional side view, of a two-operation safety buckle according to the present invention.

Referring now to FIG. 5, a buckle 50 is illustrated with a female member having similar construction to female member 24 of FIG. 2*a*. Buckle 50 however includes a male member 52 with central arms 54 that engage catch 29 with one of latches 56. When male portion 52 engages female portion 24, latch 56 rides over catch 29 and returns resiliently to a less flexed position where latch 56 and catch 29 are engaged. Arms 54 are separated by a space 55 to permit arms 54 to flex towards each other without interference from the opposite arm 54. Male and female members 52, 24 are disengaged by pressing button 26 to deflect arm 54 downward until latch 56 is free of catch 29. At the same time, side arms (not shown) are pinched together to be disengaged from cooperative retaining shoulders (not shown) to permit male and female members 52 and 24 to be separated. Because male member 52 include symmetrical arms 54 with symmetrical catches 56, male member 52 can be reversed in orientation and still provide a secondary latching feature in buckle 50.

Figure 6:
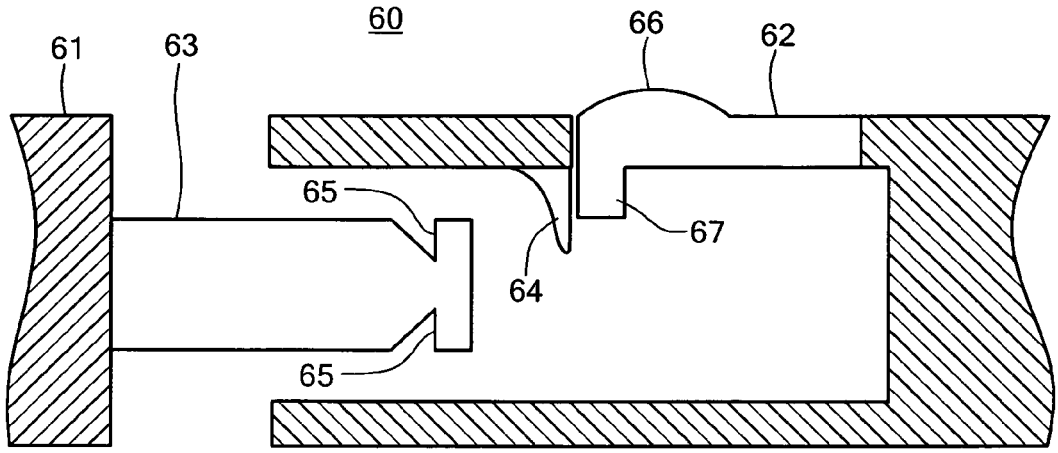
FIG. 6 illustrates a cross-sectional side view of another embodiment of a two-operation safety buckle according to the present invention.

Referring now to FIG. 6, a two-action reversible buckle 60 according to the present invention is illustrated. Buckle 60 includes male and female members 61, 62 that securely cooperate to provide a safety buckle clasp. Male member 61 includes a central arm 63 that is resiliently flexible to contribute to a secondary latching feature of buckle 60. Arms 63 includes latches 65 that engage with a catch 64 when male member 61 is completely inserted into female member 62. As an end of central arm 63 is inserted into female member 62, it meets with and is deflected by catch 64. As male member 61 continues to be inserted into female member 62, central arm 63 is deflected until latches 65 move past catch 64, at which point central arm 63 resiliently returns to a less flexed position. A secondary latching feature of buckle 60 is thus engaged. To disengage male and female members 61, 62, button 66 of female member 62 is depressed, causing displacement surface 67 to contact and displace latch 65 away from catch 64. Once latch 65 is free of catch 64, male member 61 can be disengaged from female member 62 by also pinching the side arms (not shown) of male member 61 to free them from their cooperating shoulders (not shown) on female member 62. Central arm 63 of male member 61 is symmetrical about a central axis of male member 61, such that male member 61 may be inserted into female member 62 in either orientation, i.e., orientations of male member 61 that are separated by 180 degrees with respect to a central axis of male member 61.

Figure 7:
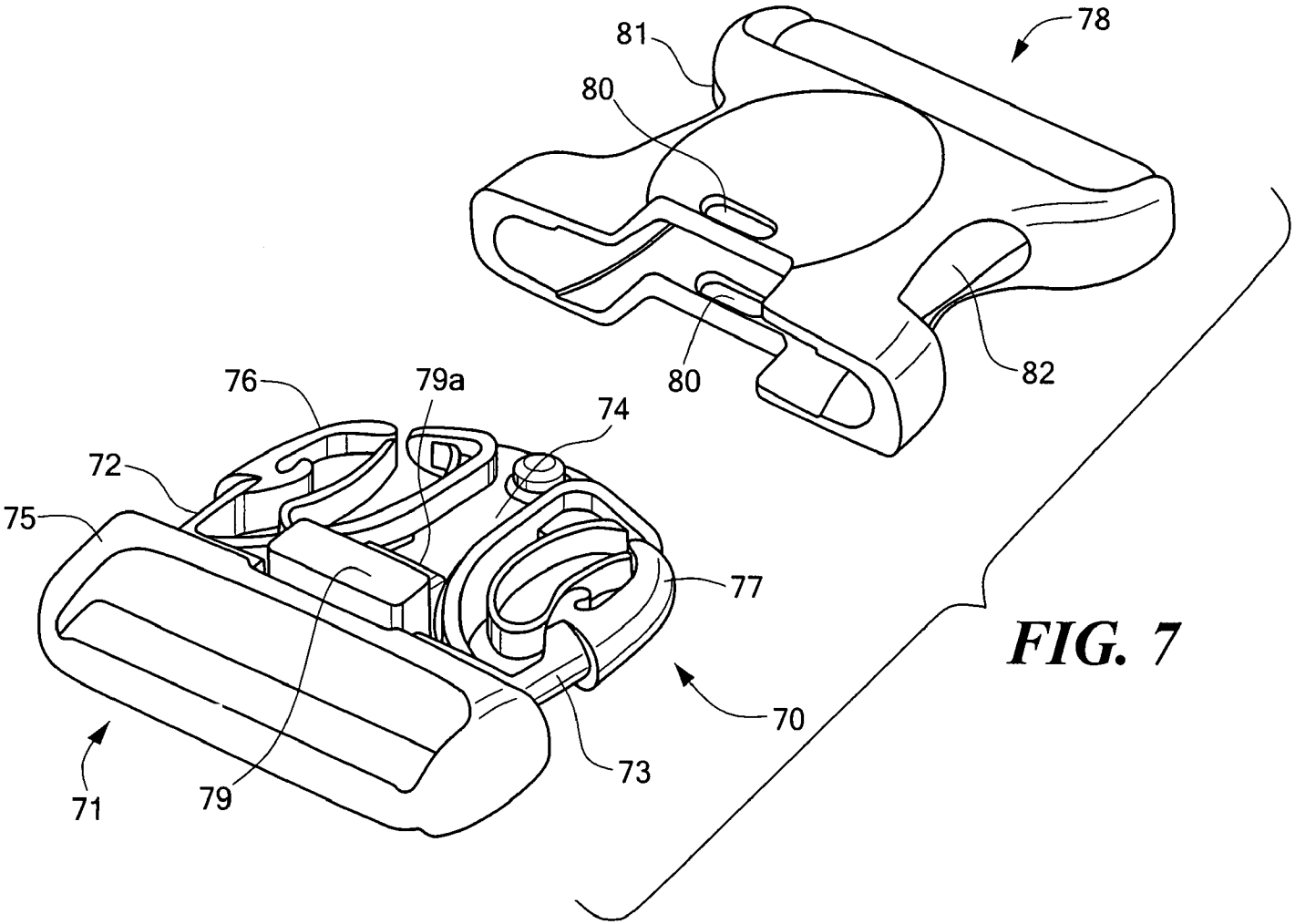
FIG. 7 illustrates a perspective view of another embodiment of a two-operation safety buckle according to the present invention.

Referring now to FIG. 7, a reversible two-action buckle assembly 70 according to the present invention is illustrated. Buckle assembly 70 includes a plug 71 with side arms 72 and 73, and a central arm 74, all connected to a base 75. Side arms 72 and 73 includes catches 76 and 77, respectively, that cooperate with corresponding catches on a socket 78. Central arm 74 has an integral lever formed with a free end having a pushbutton 79. A latch 79*a* is located adjacent to pushbutton 79. Latch 79*a* cooperates with a catch 80 located on an upper and lower surface of socket 78. Socket 78 also includes openings 81, 82 for receiving catches 76, 77, respectively. Accordingly, when plug 71 is inserted into socket 78, latch 79*a* engages catch 80, independent of the orientation of plug 71, while catches 76, 77 engage either of openings 81, 82, depending upon the orientation of plug 71 with respect to socket 78. Because socket 78 is symmetrical with respect to the insertion of plug 71, buckle 70 provides a two-action securing feature when plug 71 and socket 78 are fastened together in either orientation. Plug 71 and socket 78 are disengaged by depressing button 79 to displace latch 79*a* so that latch 79*a* is free of catch 80. Catches 76, 77 are pinched together, before, at the same time or after button 79 is depressed, to free catches 76, 77 from the cooperating latches in openings 81, 82. Once catches 76, 77 and latch 79*a* are free of their respective cooperating openings 81, 82 and catch 80, plug 71 and socket 78 can be separated.

Figure 8:
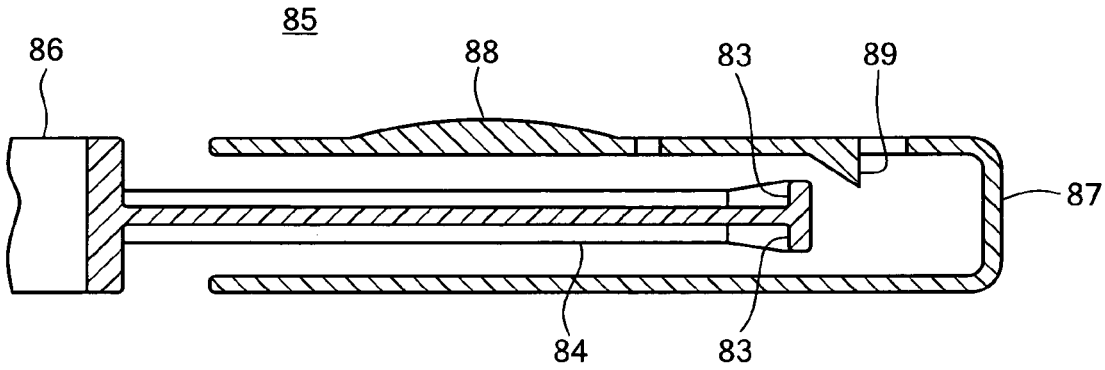
FIG. 8 illustrates a cross-sectional side view of a two-operation safety buckle according to the present invention.

Referring now to FIG. 8, a buckle 85 is illustrated with a male member 86 and a female member 87. Female member 87 includes a button 88 and a catch 89 for disengaging and engaging a central arm 84 of male member 86. Central arm 84 includes latches 83 that engage with catch 89 when male member 86 is inserted into female member 87 in either orientation. Latches 83 are disengaged from catch 89 by depressing button 88, which contacts and deflects central arm 84 to displace latches 83 so that latches 83 are free of catch 89. Because central arm 84 is symmetrical with respect to an axis of male member 86, for example, male member 86 can be inserted into female member 87 in either orientation and obtain a secondary latch feature through the cooperation of latches 83 and catch 89. Catch 89 also includes a sloped surface to permit central arm 84 to be flexibly displaced when male member 86 is inserted into female member 87, so that central arm 84 can resiliently return to a loaded or unloaded state when latches 83 and catch 89 cooperate.

Figure 9:
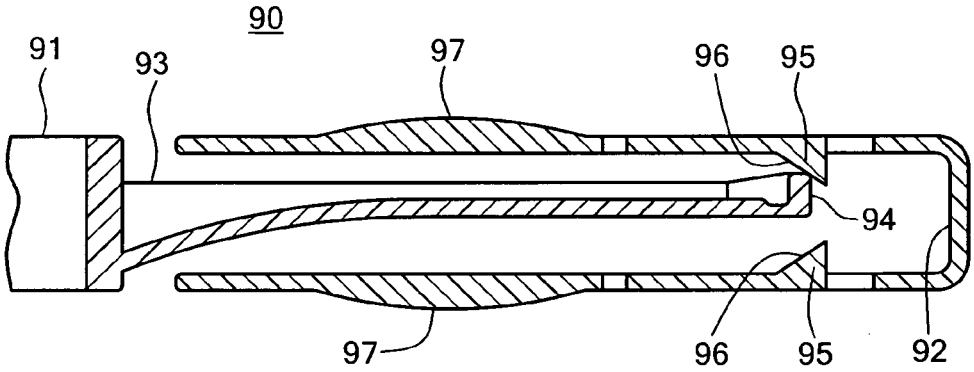
FIGS. 9 and 9A illustrate a cross-sectional side view of further embodiments of a buckle according to the present invention.

Referring now to FIG. 9, a buckle 90 is illustrated with a male member 91 and female member 92. Male member 91 has a central arm 93 with a latch 94 that cooperates with catches 95 on female member 92. Catches 95 include sloped surfaces 96 that deflect the front end of central arm 93 when male member 91 is inserted into female member 92. Central arm 93 resiliently flexes as latch 94 rides over sloped surface 96, until latch 94 passes catch 95, at which point central arm 93 resiliently returns to an unloaded or loaded state, depending upon the relationship of catch 95 and latch 94. At that point, male member 91 is secured in female member 92 by the cooperation of latch 94 and catch 95.

Female member 92 includes buttons 97 that are flexibly depressed to contact central arm 93 and deflect central arm 93 so that latch 94 can move away from catches 95 to permit male member 91 to be disengaged from female member 92. Buttons 97 are stiff so that pinching buttons 97 together do not interfere with the displacement of central arm 93 to free latch 94 from catch 95.

Figure 9A:
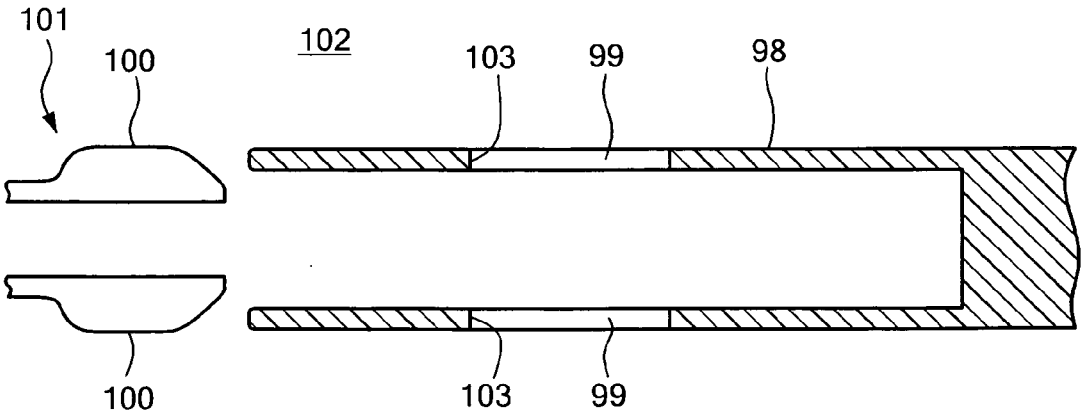

Referring now to FIG. 9*a*, a simplified female member 98 includes two openings 99 sized and shaped to receive two central prongs 100 of a male member 101. Prongs 100 are received in both openings 99 of female member 98 to secure male member 101 within female member 98. According to this embodiment, buckle 102 is unclasped by pinching two side arms (not shown) to free the side arms from their cooperating catches (not shown) on female member 98, while also pinching prongs 100 to free them from cooperating catches 103 of female member 98. Buckle 102 thus requires two separate pinching actions to unclasp male and female members 101, 98, thereby providing a double action, reversible, child resistant buckle.

Figure 10:
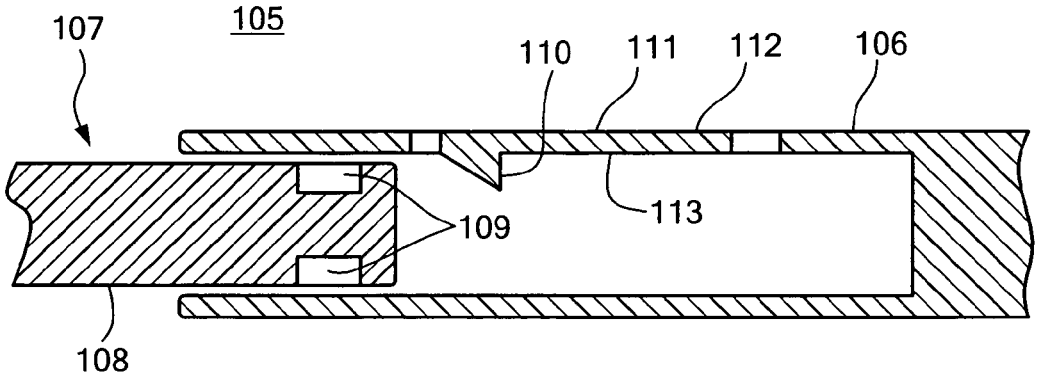
FIG. 10 illustrates a cross-sectional side view of another embodiment of a two-operation safety buckle in accordance with the present invention.
Figure 11:
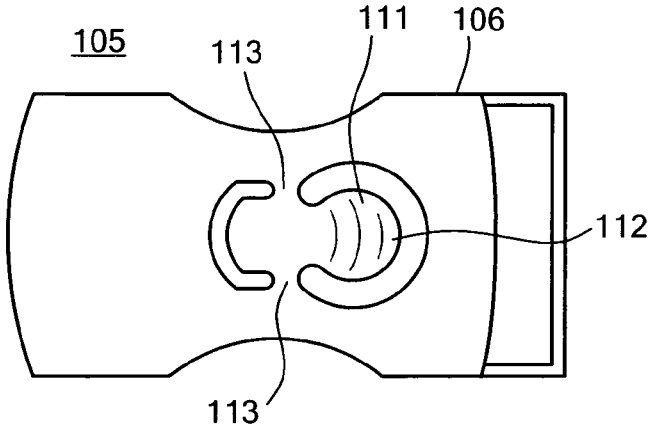
FIG. 11 illustrates a plan view of a female buckle portion according to the embodiment of FIG. 10.

Referring now to FIG. 10, another embodiment of the reversible double action buckle according to the present invention is illustrated as buckle 105. Buckle 105 includes female member 106 and male member 107, with central arm 108 being attached to male member 107. Central arm 108 has a cross-sectional dimension that provides small clearances when inserted into female member 106 to improve the stability of the coupling of male member 107 and female member 106. Central arm 108 also includes recesses 109 that cooperate with catch 110 on rocker arm 111 of female member 106. Accordingly, when central arm 108 is inserted into female member 106, recesses 109 and catch 110 cooperate to prevent male member 107 from being removed from female member 106. Aside from pinching side arms (not shown) to free them from cooperating catches (not shown) on female member 106, male member 107 is released from female member 106 by depressing a button 112 on rocker arm 111 to pivot rocket arm 111 about a fulcrum 113 to displace catch 110 upwards so that catch 110 is free of recesses 109. Once catch 110 is free of recesses 109, central arm 108 can be withdrawn from female member 106, as long as other latches and catches are disengaged. Because central arm 108 is symmetrical about an axis of male member 107, the latching of recesses 109 with catch 110 is independent of the orientation of female member 107 with respect to central arm 108. Optionally, button 112 can be provided with a message or a bright color to indicate that buckle 105 may be unlatched by depressing button 112.

Figure 12:
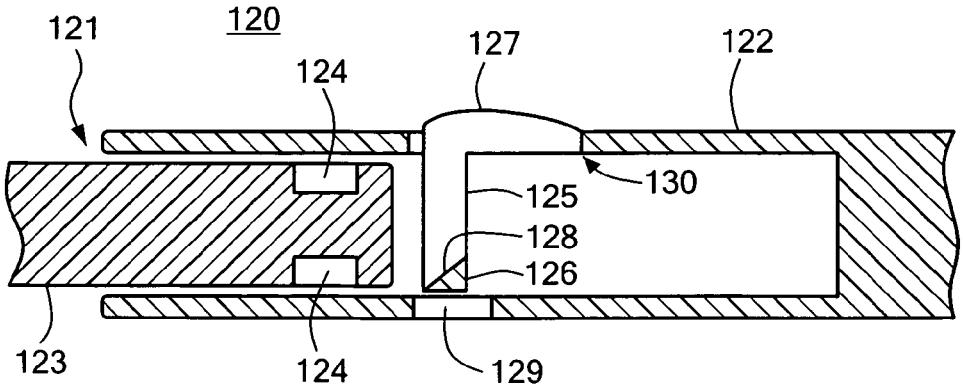
FIG. 12 illustrates a cross-sectional side-view of another embodiment of a reversible two-operation safety buckle in accordance with the present invention.

Referring now to FIG. 12, another embodiment of the reversible, double action buckle according to the present invention is illustrated as buckle 120. Buckle 120 includes male member 121 and female member 122. Male member 121 includes a central arm 123 that includes recesses 124. Female member 122 includes a catch 126 by pivot arm 125 that is coupled to a button 127. Catch 126 includes a sloped surface 128 that cooperates with an end of central arm 123 when male member 121 is inserted into female member 122. As male member 121 is inserted into female member 122, an end of central arm 123 contacts surface 128 to displace arm 125, catch 126 and button 127 downward through an opening 129 in female member 122. As male member 121 is inserted further into female member 122, recesses 124 cooperate with catch 126 to retain central arm 123 in female member 122. Arm 125 resiliently pivots about a point 130 to permit central arm 123 to slide past catch 126, and to permit arm 125 to return to an upright position so that catch 126 engages recesses 124 when male member 121 is fully inserted into female member 122. In this embodiment, central arm 123 may be composed of two parallel central arms side-by-side that both have recesses 124 and both engage catch 126. Alternatively, a single central arm can be provided that slides past one side of arm 125 to permit catch 126 to engage recess 124. In either instance, central arm 123 is symmetrical about an axis of male member 121 so that catch 126 and recess 124 engage each other independent of the orientation of male member 121.

Male member 121 and female member 122 are released by disengaging all other latches in buckle 120, and depressing button 127 to displace catch 126 into opening 129. As catch 126 is displaced into opening 129, catch 126 is free of recess 124 so that central arm 123 may be disengaged from female member 122. The embodiment of buckle 120 provides additional stability because of the smaller clearances between central arm 123 and female member 122 than would be provided if central arm 123 were made to flex, as is the case in other embodiments described above.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A safety buckle, comprising:

a socket having a cavity with a first surface;

a first catch in the cavity and adjoining the first surface and directed away from the first surface;

a plug with a central arm for insertion into the socket;

a first latch on the central arm sized and positioned to permit engagement with the first catch when the plug is inserted into the socket in a first relative orientation to releaseably retain the plug and socket together;

a second catch or second latch on an opposing side of the cavity or central arm, respectively, and sized and positioned with a symmetry to the first catch or first latch, respectively, to permit an alternate engagement with the corresponding first catch or first latch, such that the socket and plug may be releaseably retained together in a second relative orientation different from the first relative orientation;

one of the first or second latches on the central arm or one of the first or second catches in the cavity being free from engagement when the plug and socket are releaseably retained together; and a disengagement device on the socket or plug and integral with the socket or plug and operable to displace the central arm when actuated to disengage one or more engagements involving the central arm.

2. The buckle according to claim 1, wherein the central arm includes the second latch for cooperating with the first catch of the socket.

3. The buckle according to claim 1, wherein:

the socket includes the second catch; and the first latch is a protrusion of the central arm.

4. The buckle according to claim 1, wherein:

the cavity comprises a second surface opposing the first surface;

the first catch comprises a first opening in the first surface;

the second catch comprises a second opening in the second surface;

the first and second openings being sized and shaped to cooperate with the first latch on the central arm of the plug.

5. A safety buckle, comprising:

a first buckle member having a projection with a first engagement part located thereon;

a second buckle member having a cavity for receiving the projection with a second engagement part located therein;

the first and second engagement parts being cooperative to retain the first and second buckle members together when the projection is inserted into the cavity in a first relative orientation;

one of the first or second engagement parts having a symmetrically functional counterpart, such that another of the first or second engagement parts cooperates with the counterpart to retain the first and second buckle members together when the projection is inserted into the cavity in a relative orientation different from the first relative orientation, the one of the first or second engagement parts being free from engagement; and a disengagement device integral with the first or second buckle member and operable to displace the projection to disengage cooperative engagement parts or the counterpart when actuated.

6. The safety buckle according to claim 5, wherein the projection further comprises a central arm.

7. The safety buckle according to claim 6, wherein the counterpart is located on an opposite side of the central arm from the first engagement part.

8. The safety buckle according to claim 6, wherein the first engagement part is on the central arm and is formed as a recess with a shoulder near an end of the central arm, the counterpart also being arranged on the central arm.

9. The safety buckle according to claim 5, wherein the projection further comprises two central arms, one central arm having the first engagement part thereon, and the other central arm having the counterpart.

10. The safety buckle according to claim 5, wherein one of the first or second engagement parts is located on the disengagement device.

11. A safety buckle that can be clasped in a plurality of orientations, comprising:

a first buckle member and a second buckle member, being complementary shaped to fit together with each other in a clasped condition;

a cavity in one of the first or second buckle members;

a projection on another of the first or second buckle members, the projection being inserted into the cavity of the one of the first or second buckle members in the clasped condition;

a first engagement structure on the projection and a second engagement structure in the cavity, the first and second engagement structures being sized and positioned to cooperate with each other to retain the first and second buckle members together in the clasped condition in a first orientation;

a third engagement structure located on the projection and sized and positioned to cooperate with the second engagement structure to retain the first and second buckle members together in the clasped condition in a second orientation different from the first orientation;

the first engagement structure being free from engagement in the second orientation;

the projection further comprising two central arms, one central arm having the first engagement structure, and the other central arm having the third engagement structure the two central arms being symmical about an axis lying along an insertion direction of the projection to the cavity; and a disengagement device integral with the first or the second buckle member and operable to displace the projection to disengage the first and second engagement structures when in the first orientation and the second and third engagement structures when in the second orientation when actuated.

12. The safety buckle according to claim 11, wherein the first engagement structure or the third engagement structure on a respective central arm is formed as a recess with a shoulder near an end of the respective central arm.

* * * * *